US008701578B2

(12) United States Patent
Chung et al.

(10) Patent No.: US 8,701,578 B2
(45) Date of Patent: Apr. 22, 2014

(54) DIGITAL GARMENT USING EMBROIDERY TECHNOLOGY AND FABRICATING METHOD THEREOF

(75) Inventors: Gi Soo Chung, Gyeonggi-do (KR); Dae Hoon Lee, Gyeonggi-do (KR); Jae Sang An, Gyeonggi-do (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 909 days.

(21) Appl. No.: 12/919,432

(22) PCT Filed: Feb. 12, 2009

(86) PCT No.: PCT/KR2009/000679

§ 371 (c)(1),
(2), (4) Date: Aug. 25, 2010

(87) PCT Pub. No.: WO2009/107939

PCT Pub. Date: Sep. 3, 2009

(65) Prior Publication Data

US 2011/0000412 A1 Jan. 6, 2011

(30) Foreign Application Priority Data

Feb. 26, 2008 (KR) ..... 10-2008-0017487

(51) Int. Cl.
*D05C 17/00* (2006.01)

(52) U.S. Cl.
USPC ..... 112/439; 112/475.18; 2/905

(58) Field of Classification Search
USPC ..... 112/402, 439, 475.18, 78; 2/902, 905; 700/130–132, 136–138
See application file for complete search history.

(56) References Cited

U.S. PATENT DOCUMENTS 3,699,768 A * 10/1972 Roberts et al. ..... 57/213
4,793,130 A * 12/1988 Togashi et al. ..... 57/210
6,032,450 A * 3/2000 Blum ..... 57/75

(Continued)

FOREIGN PATENT DOCUMENTS

| | | |
|---|---|---|
| JP | 2001-262408 | 9/2001 |
| KR | 2004-0018306 | 3/2004 |
| KR | 10-2007-00609 71 | 6/2007 |
| KR | 10-08190505 | 3/2008 |

OTHER PUBLICATIONS

International Search Report mailed Sep. 24, 2009 for PCT/KR2009/000679.

(Continued)

*Primary Examiner* — Nathan Durham

(57) ABSTRACT

Disclosed is a digital garment using embroidery technology. In the digital garment, a digital embroidery pattern is formed on a common garment to provide a communication path, an antenna pattern, etc. The digital garment comprises a garment made of a textile and having one side and the other side opposite to each other, a digital embroidery pattern formed along the inner or outer surface of the garment using embroidery technology to provide a communication path to the garment, a sensor attached to the garment and electrically connected to the digital embroidery pattern to convert physical signals to electrical signals, an arithmetic unit attached to the garment and electrically connected to the digital embroidery pattern to process the electrical signals inputted from the sensor, and a communication module attached to the garment and electrically connected to the digital embroidery pattern to perform wireless communication. Further disclosed is a method for fabricating the digital garment using embroidery technology.

17 Claims, 6 Drawing Sheets

(56) References Cited

U.S. PATENT DOCUMENTS

| | | | | |
|---|---|---|---|---|
| 6,210,771 | B1 * | 4/2001 | Post et al. | 428/100 |
| 6,243,870 | B1 * | 6/2001 | Graber | 2/905 |
| 6,476,581 | B2 | 11/2002 | Lew | |
| 6,970,731 | B1 | 11/2005 | Jayaraman et al. | |
| 7,592,276 | B2 * | 9/2009 | Hill et al. | 442/301 |
| 2001/0024949 | A1 | 9/2001 | Yanagida et al. | |
| 2004/0194996 | A1 * | 10/2004 | Ysbrand | 174/102 SC |
| 2009/0050362 | A1 * | 2/2009 | Burke et al. | 174/388 |
| 2010/0317954 | A1 | 12/2010 | Jeong et al. | |

OTHER PUBLICATIONS

Written Opinion of the International Search Report mailed Sep. 24, 2009 for PCT/KR2009/000679.

* cited by examiner

DIGITAL GARMENT USING EMBROIDERY TECHNOLOGY AND FABRICATING METHOD THEREOF

This application claims the priority of Korean Patent Application No. 10-2008-0017487, filed on Feb. 26, 2008 in the KIPO (Korean Intellectual Property Office), the disclosure of which is incorporated herein entirely by reference. Further, this application is the National Stage application of International Application No. PCT/KR2009/000679, filed Feb. 12, 2009, which designates the United States and was published in English. Each of these applications is hereby incorporated by reference in their entirety into the present application.

TECHNICAL FIELD

The present invention relates to a digital garment using embroidery technology and a fabrication method thereof.

BACKGROUND ART

In the near future, people will be living in a ubiquitous world where they can access networks in real time to exchange information everywhere at any time. Under these circumstances, there is a need for digital garments that people wear to perform an information exchange function through access to the surrounding networks. To meet this need, digital yarns, which are a kind of thread through which electrons can move to transmit information, that can be woven or knitted to fabricate digital garments are currently used.

However, digital yarn strands should be connected to connectors in a one-to-one relationship, undesirably causing a long processing time in the fabrication of digital garments. Further, when it is intended to fabricate a garment using a digital yarn fabric, additional work is required to connect digital yarns at seams of the garment, rendering the overall fabrication process complicated. Further, when it is intended to attach digital yarns to a garment, a process for reprocessing the digital yarns is inevitably required, making the fabrication process complex.

DISCLOSURE OF INVENTION

Technical Problem

An object of the present invention is to provide a digital garment using embroidery technology in which a digital embroidery pattern is formed on a common garment to provide a communication path, an antenna pattern, etc.

Another object of the present invention is to provide a method for fabricating the digital garment using embroidery technology.

Technical Solution

In accordance with an aspect of the present invention, the above and other objects can be accomplished by the provision of a digital garment using embroidery technology which comprises a garment made of a textile and having one side (hereinafter, referred to as a 'first side' and the other side (hereinafter, referred to as a 'second side' opposite to each other, a digital embroidery pattern formed along the inner or outer surface of the garment using embroidery technology to provide a communication path to the garment, a sensor attached to the garment and electrically connected to the digital embroidery pattern to convert physical signals to electrical signals, an arithmetic unit attached to the garment and electrically connected to the digital embroidery pattern to process the electrical signals inputted from the sensor, and a communication module attached to the garment and electrically connected to the digital embroidery pattern to perform wireless communication.

The digital embroidery pattern may include upper threads that sequentially penetrate the first and second sides of the garment to form hooks on the second side of the garment and sequentially penetrate the second and first sides of the garment to form a desired shape on the first side of the garment, and lower threads interlocked with the upper threads while passing through the hooks on the second side of the garment, either the upper threads or the lower threads or both being digital yarns.

The upper threads may be digital yarns and the lower threads may be sewing yarns. Alternatively, the upper threads may be sewing yarns and the lower threads may be digital yarns. Alternatively, both the upper and lower threads may be digital yarns.

The sewing yarns may be composed of a material selected from cotton, silk, linen and synthetic fibers.

Each of the digital yarns may include at least one metal part positioned at the center of the cross section thereof to provide a communication path and a coating portion surrounding the metal part to shield electromagnetic waves. Each of the digital yarns may further include cover yarns surrounding the coating portion. Each of the digital yarns may further include outer metal parts arranged along the outer circumference of the coating portion and an outer coating portion surrounding the outer metal parts.

The metal part may be made of a material selected from the group consisting of copper, copper alloys, silver, silver alloys, gold, gold alloys, brass and combinations thereof.

The digital garment may further comprise a display attached to the garment and electrically connected to the digital embroidery pattern to display processing results from the arithmetic unit as images.

The display may be a liquid crystal display (LCD) or an organic light emitting display (OLED).

The digital garment may further comprise an input pad attached to the garment and electrically connected to the digital embroidery pattern to apply electrical input signals to the arithmetic unit.

The digital garment may further comprise an electric module attached to the garment so as to be electrically connected to the digital embroidery pattern.

In accordance with another aspect of the present invention, there is provided a method for fabricating a digital garment using embroidery technology which comprises preparing a garment made of a textile and having a first side and a second side opposite to each other, forming a digital embroidery pattern along the inner or outer surface of the garment using an embroidery machine to provide a communication path to the garment, and attaching devices to the garment and electrically connecting the devices to the digital embroidery pattern.

The digital embroidery pattern may be formed using either upper threads or lower threads or both as digital yarns using an embroidery machine. The digital embroidery pattern may be formed by allowing the upper threads to sequentially penetrate the first and second sides of the garment to form hooks on the second side of the garment, allowing the lower threads to pass through the hooks to interlock the lower threads with the upper threads on the second side of the garment, and allowing the upper threads to sequentially penetrate the second and first sides of the garment to form a desired shape on the first side of the garment.

The devices may include a sensor, an arithmetic unit and a communication module.

The digital garment may further comprise at least one device selected from displays, input pads and electric modules that is attached to the garment and electrically connected to the digital embroidery pattern.

Advantageous Effects

The digital garment using embroidery technology and the fabrication method thereof according to the present invention offer the following advantages. The digital embroidery pattern can be formed using either upper threads or lower threads or both as digital yarns to easily provide a communication path with surrounding computing devices, an antenna pattern, etc.

Further, the digital embroidery pattern is formed on the garment by interlocking upper threads having hooks and lower threads using an embroidery machine to achieve increased bonding with the garment. As a result, the ability of the digital embroidery pattern to resist external forces can be improved to prevent the digital garment from being torn and damaged during washing.

Further, the digital embroidery pattern can have various shapes on the garment based on embroidery technology using an embroidery machine to create's an aesthetic feeling of the digital garment.

Further, various devices can be attached to the garment and electrically connected to the digital embroidery pattern to provide various convenient functions, including display and communication, to a user.

BRIEF EXPLANATION OF ESSENTIAL PARTS OF THE DRAWINGS

1000: Digital garment using embroidery technology
1100: Garment 1200: Digital embroidery pattern
1300: Sensor 1400: Input pad
1500: Arithmetic unit 1600: Display
1700: Communication module 1800: Electric module

BEST MODE FOR CARRYING OUT THE INVENTION

Preferred embodiments of the present invention will now be described in greater detail with reference to the accompanying drawings in such a manner that they can easily be carried out by a person having ordinary skill in the art to which the invention pertains.

Hereinafter, a description will be given of the constitution of a digital garment 1000 using embroidery technology according to an embodiment of the present invention.

Figure 1:
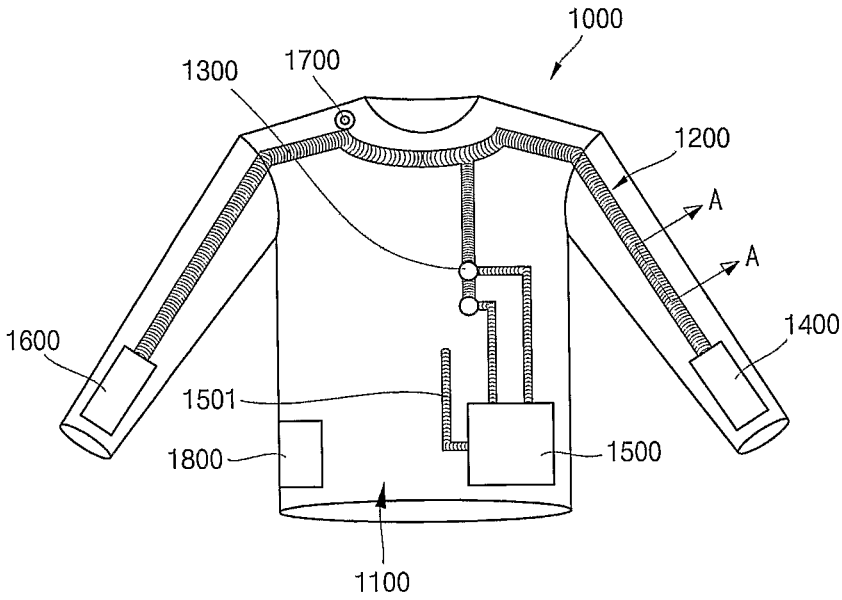
FIG. 1 is a perspective view illustrating a digital garment using embroidery technology according to an embodiment of the present invention.
Figure 2:
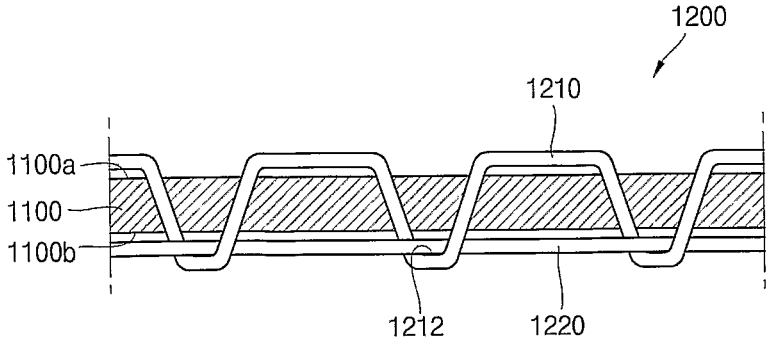
FIG. 2 is a cross-sectional view taken along line A-A of FIG. 1.
Figure 3:
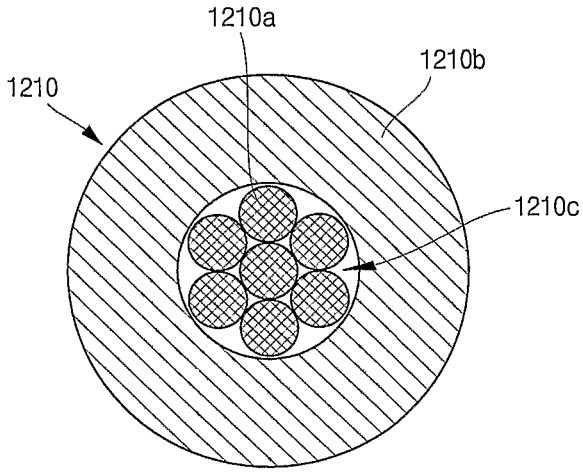
FIG. 3 is a cross-sectional view of a digital yarn as the upper thread illustrated in FIG. 2.
Figure 4:
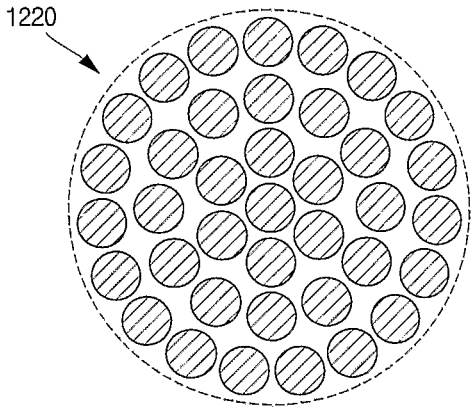
FIG. 4 is a cross-sectional view of a sewing yarn as the lower thread illustrated in FIG. 2.
Figure 5:
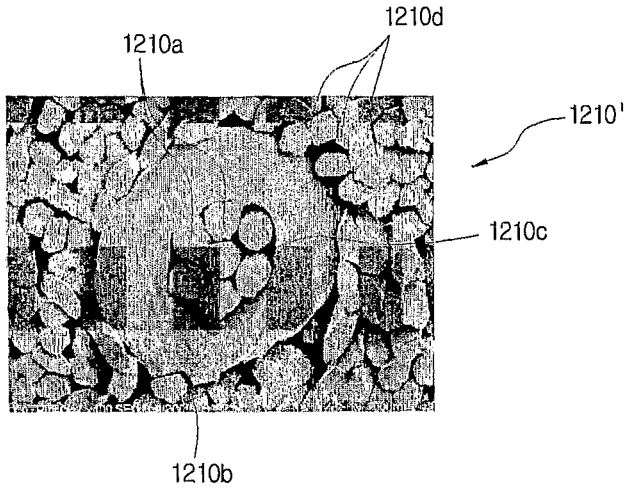
FIG. 5 is a photograph of another digital yarn as the upper thread illustrated in FIG. 2.

FIG. 1 is a perspective view illustrating the digital garment, FIG. 2 is a cross-sectional view taken along line A-A of FIG. 1, FIG. 3 is a cross-sectional view of a digital yarn as the upper thread illustrated in FIG. 2, FIG. 4 is a cross-sectional view of a sewing yarn as the lower thread illustrated in FIG. 2, and FIG. 5 is a photograph of another digital yarn as the upper thread illustrated in FIG. 2.

Referring to FIGS. 1 through 5, the digital garment 1000 according to an embodiment of the present invention may comprise a garment 1100, a digital embroidery pattern 1200 formed on the garment 1000, and a sensor 1300, an arithmetic unit 1500 and a communication module 1700 attached to the garment 1000 and electrically connected to the digital embroidery pattern 1200. The digital garment 1000 may further comprise an input pad 1400, a display 1600 and an electric module 1800, all of which are attached to the garment 1100 and electrically connected to the digital embroidery pattern 1200.

The garment 1100 may be any suitable garment. It should be understood that although an upper garment is illustrated as the garment 1100 in FIG. 1, the garment 1100 may be any clothing product such as a lower garment or a one-piece garment. The garment 110 may have a first side 1100*a* and a second side 1100*b* opposite to each other.

The digital embroidery pattern 1200 is formed along the shape of the garment 1100 using embroidery technology. That is, the digital embroidery pattern 1200 is formed by interlocking the upper thread 1210 and the lower thread 1220 together using an embroidery machine (not shown). The digital embroidery pattern 1200 provides a communication path between the garment 1100 and the surrounding computing devices or an antenna pattern. For example, the reference numeral 1501 in FIG. 1 may be defined as an antenna pattern.

By using the embroidery machine, the upper thread 1210 sequentially penetrates the first and second sides 1100*a* and 1100*b* of the garment 1100, is bent on the second side 1100*b* opposite to the first side 1100*a* of the garment 1100 to form a hook 1212, and sequentially penetrates the second and first sides 1100*b* and 1100*a* of the garment 1100 to form a desired shape on the first side 1100*a* of the garment 1100. Although FIG. 1 illustrates a linear shape between the devices 1300 through 1800, the shape may vary depending on the intended design. For example, the shape may be a floral or letter pattern. The shape should be formed in a continuous pattern to provide a communication path in the garment 1100. One side of the shape may be connected to the computing device and the other side thereof may be an unconnected antenna pattern 1501.

As illustrated in FIG. 3, the upper thread 1210 may be a digital yarn to provide a substantial communication path between the garment 1100 and the surrounding computing devices.

The upper thread 1210 includes one or more metal parts 1210*a* positioned at the center of the cross section thereof and a coating portion 1210*b* surrounding the metal parts 1210*a*. Voids 1210*c* may be formed in vacant spaces between the metal parts 1210*a* and the coating portion 1210*b* where the coating portion 1210*b* is not introduced into regions between the metal parts 1210*a*.

The metal parts 1210*a* are composed of a metal having a low electrical resistance and a high elastic recovery under repeated bending. For example, the metal parts 1210*a* may be made of a material selected from the group consisting of copper, copper alloys, silver, silver alloys, gold, gold alloys, brass and combinations thereof. Seven metal parts 1210*a* are illustrated in FIG. 3, but there is no restriction on the number of the metal parts 1210*a*.

The coating portion 1210*b* is formed so as to surround the metal parts 1210*a*. When the digital embroidery pattern 1200 is used for communication, the coating portion 1210*b* shields electromagnetic waves generated from the metal parts 1210*a* to prevent the electromagnetic waves from reaching the wearer's body. The coating portion 1210*b* prevents external electromagnetic noise from entering the metal parts 1210*a* of the digital embroidery pattern 1200. The coating portion 1210*b* may be formed of a material selected from, but not limited to, ethylene tetrafluoroethylene (ETFE), fluorinated ethylene propylene (FEP), polytetrafluoroethylene (PTFE), polyvinylidene fluoride (PVDF), perfluoroalkoxy (PFA) and equivalents thereof.

The lower thread 1220 is interlocked with the upper thread 1210 while passing through the hooks 1212, which are formed by bending the upper thread 1210 on the second side 1100*b* opposite to the first side 1100*a* of the garment 1100. With this arrangement, the lower thread 1220 holds the upper thread 1210 on the second side 1100*b* opposite to the first side 1100*a* of the garment 1100 to reinforce the strength of the upper thread 1210 weakened by the bending operation. The lower thread 1220 is disposed parallel to the second side 1100*b* of the garment 1100, unlike the upper thread 1210 bent on the second side 1100*b* opposite to the first side 1100*a* of the garment 1100.

As illustrated in FIG. 4, the lower thread 1220 may be a sewing yarn. The sewing yarn may be composed of a material selected from cotton, silk, linen and synthetic fibers. FIG. 4 illustrates the lower thread 1220 in the form of a multiple-ply yarn in which two or more sewing yarn strands are twisted together into a single-ply yarn, but the structure of the lower thread 1220 is not limited to the ply yarn structure.

FIG. 5 illustrates a digital yarn as another upper thread 1210' in which a plurality of cover yarns 1210*d* surround the surface of the coating portion 1210*b*. The thickness of the cover yarns 1210*d* is almost equal to the diameter of the metal parts 1210*a*. The cover yarns 1210*d* are substantially parallel to the lengthwise direction of the coating portion 1210*b*. Although the cover yarns 1210*d* may be made of substantially the same material as the lower thread 1220, there is no limitation on the material for the cover yarns 1210*d*.

The covering of the surface of the coating portion 1210*b* with the cover yarns 1210*d* further improves the strength of the digital yarn as the upper thread 1210 to prevent the digital yarn from being snapped due to friction during embroidery or washing. In other words, when the upper thread 1210 is smaller in diameter than the lower thread 1220, there exists the risk that the digital yarn 1210 may be snapped due to friction during embroidery or washing. In contrast, since the diameter of the upper thread 1210' including the cover yarns 1210*d* is similar to that of the lower thread 1220, there is no risk that the upper thread 1210' may be snapped due to friction during embroidery or washing, and therefore, the performance of the digital yarn 1210' as a communication line or an antenna pattern can be maintained for a long period of time.

The sensor 1300 is attached to the garment 1100 so as to be electrically connected to the digital embroidery pattern 1200. The sensor 1300 can detect various physical signals, such as movement, vibration, temperature and pressure, of a user or surrounding objects to convert the physical signals to electrical signals. The sensor 1300 may be provided in plurality according to the intended applications. The electrical signals, which are converted from the physical signals detected by the sensor 1300, are transmitted to the arithmetic unit 1500 via the digital embroidery pattern 1200.

The input pad 1400 is attached to the garment 1100 so as to be electrically connected to the digital embroidery pattern 1200. There is no restriction on the position of the input pad. For convenience of use, the input pad 1400 is attached around the wearer's wrist (FIG. 1). The input pad 1400 may be implemented in a keypad or a touch screen manner. When the input pad 1400 is implemented in a touch screen manner, it may be integrated with the display 1600.

The arithmetic unit 1500 is attached to the garment 1100 so as to be electrically connected to the digital embroidery pattern 1200. The arithmetic unit 1500 receives signals inputted from the sensor 1300, the input pad 1400 and the communication module 1700, and performs a series of arithmetic operations to analyze and process the signals. The arithmetic unit 1500 can apply electrical signals for communication to the communication module 1700 via the digital embroidery pattern 1200.

The display 1600 is attached to the garment 1100 so as to be electrically connected to the digital embroidery pattern 1200. The display 1600 is electrically connected to the arithmetic unit 1500 via the digital embroidery pattern 1200. With this configuration, the display 1600 can display processing results from the arithmetic unit 1500 as images. The display 1600 may be a liquid crystal display (LCD), an organic light emitting display (OLED) or an equivalent thereof, but the present invention is not limited thereto.

The communication module 1700 is attached to the garment 1100 so as to be electrically connected to the digital embroidery pattern 1200. The communication module 1700 is electrically connected to the arithmetic unit 1500 via the digital embroidery pattern 1200. Due to this electrical connection, the communication module 1700 receives the processing results from the arithmetic unit 1500 and performs wireless communication with surrounding computing devices.

The electric module 1800 is attached to the garment 1100 so as to be electrically connected to the digital embroidery pattern 1200. Input/output terminals corresponding to the reference formats are housed in the electric module 1800. The electric module 1800 may include various devices. Examples of such devices include, but are not limited to, semiconductor chips, magnetic storage devices, capacitors, inductors, resistors, crystals, coils, varactors, thermistors, resonators, transformers, electrical circuits, electro-optical circuits, optical configurations, electromagnetic circuits, and components (e.g., connectors) capable of being connected to magnetic configurations.

As described above, in the digital garment 1000 according to the embodiment of the present invention, the digital embroidery pattern 1200 can be formed by interlocking digital yarns as the upper threads 1210 and the lower threads to easily provide a communication path with the surrounding computing devices or an antenna path.

Further, the digital embroidery pattern 1200 is formed on the garment 1100 by interlocking the upper threads 1210 having the hooks 1212 and the lower threads 1220 using an embroidery machine to achieve increased bonding with the garment 1100. As a result, the ability of the digital embroidery pattern 1200 to resist external forces can be improved to prevent the digital garment 1000 from being torn and damaged during washing.

Further, the digital embroidery pattern 1200 can have various shapes on the garment 1100 based on embroidery technology using an embroidery machine to create an aesthetic feeling of the digital garment 1000.

Further, various devices 1300 through 1800 can be attached to the garment 1100 and electrically connected to the digital embroidery pattern 1200 to provide various convenient functions, including display and communication, to a user.

Hereinafter, a description will be given of the constitution of a digital garment (not shown) using embroidery technology according to a further embodiment of the present invention.

Figure 6:
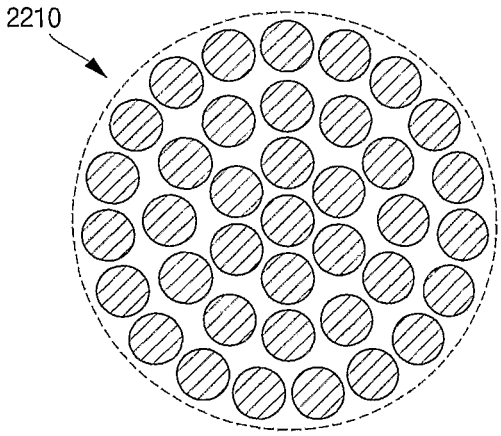
FIGS. 6 and 7 are cross-sectional views of a sewing yarn as an upper thread and a digital yarn as a lower thread of a digital garment using embroidery technology according to a further embodiment of the present invention.
Figure 7:
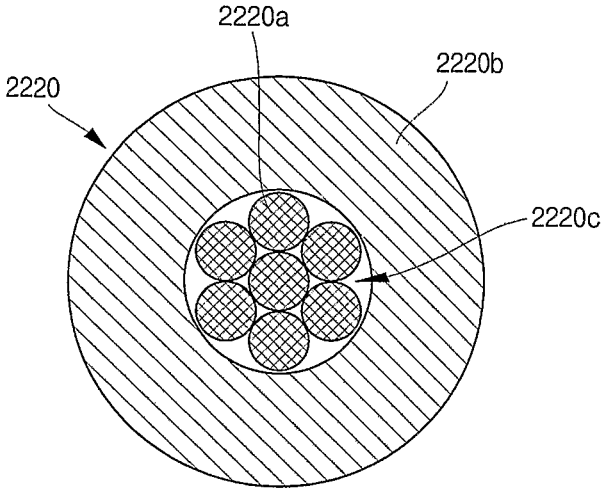

FIGS. 6 and 7 show cross-sectional views of a sewing yarn as an upper thread and a digital yarn as a lower thread of the digital garment, respectively.

The digital garment according to the embodiment of the present invention has the same elements and functions as the digital garment 1000 according to the previous embodiment of the present invention except for the constructions of the upper and lower threads forming a digital embroidery pattern, and thus the description of the same elements is omitted.

Referring to FIGS. 6 and 7, a digital embroidery pattern of the digital garment according to the embodiment of the present invention is formed by interlocking a sewing yarn as the upper thread 2210 and a digital yarn as the lower thread 2220.

Like the upper thread 1210 illustrated in FIG. 2, the upper thread 2210 sequentially penetrates the first and second sides 1100*a* and 1100*b* of the garment 1100, is bent on the second side 1100*b* opposite to the first side 1100*a* of the garment 1100 to form a hook, and sequentially penetrates the second and first sides 1100*b* and 1100*a* of the garment 1100 to form a desired shape on the first side 1100*a* of the garment 1100. Merely, the upper thread 2210 may be a sewing yarn composed of a material selected from cotton, silk, linen and synthetic fibers. FIG. 6 illustrates the upper thread 2210 in the form of a multiple-ply yarn in which two or more sewing yarn strands are twisted together into a single-ply yarn, but the structure of the upper thread 2210 is not limited to the ply yarn structure.

Like the lower thread 1220 illustrated in FIG. 2, the lower thread 2220 is interlocked with the upper thread 2210 while passing through the hooks, which are formed by bending the upper thread 2210 on the second side 1100*b* of the garment 1100, and is disposed parallel to the second side 1100*b* of the garment 1100. Merely, the lower thread 2220 includes one or more metal parts 2220*a* positioned at the center of the cross section thereof and a coating portion 2220*b* surrounding the metal parts 2220*a*. Voids 2220*c* may be formed in vacant spaces between the metal parts 2220*a* and the coating portion 2220*b* where the coating portion 2220*b* is not introduced into regions between the metal parts 2220*a*.

As described above, the use of a digital yarn as the lower thread 2220 disposed parallel to the second side of the garment 1100 in the digital garment according to the embodiment of the present invention increases the ability of the digital yarn to resist external forces, compared to the use of a digital yarn as the upper thread 1210 having the hooks 1212 in a bent form in the digital embroidery pattern 1200 of the digital garment 1000 according to the previous embodiment of the present invention. As a result, deformation and damage of the digital yarn serving as a substantial communication path can be reduced. Thus, the digital garment according to the embodiment of the present invention can prevent a communication error that may arise from the deformation and damage of the digital yarn.

Hereinafter, a description will be given of the constitution of a digital garment (not shown) using embroidery technology according to another embodiment of the present invention.

Figure 8:
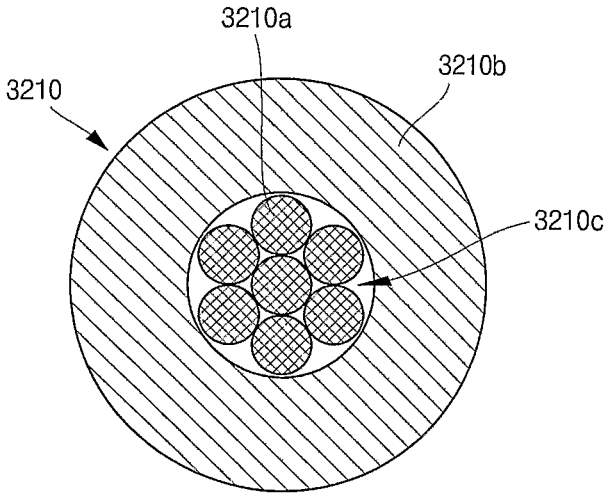
FIGS. 8 and 9 are cross-sectional views of a digital yarn as an upper thread and a digital yarn as a lower thread of a digital garment using embroidery technology according to another embodiment of the present invention.
Figure 9:
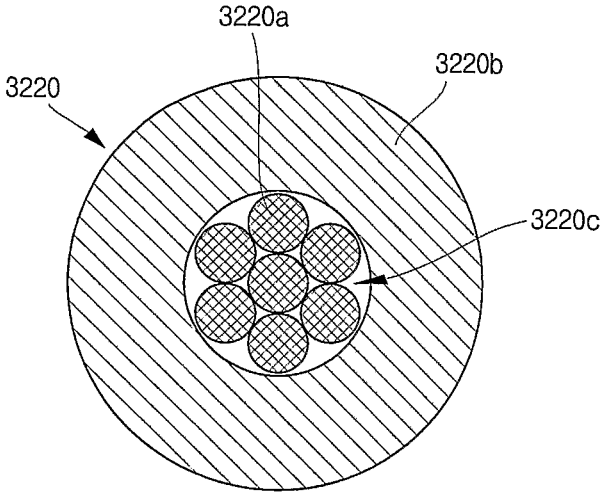

FIGS. 8 and 9 show cross-sectional views of a digital yarn as an upper thread and a digital yarn as a lower thread of the digital garment.

The digital garment according to the embodiment of the present invention has the same elements and functions as the digital garment 1000 according to the previous embodiment of the present invention except that both the upper and lower threads forming a digital embroidery pattern are digital yarns, and thus the description of the same elements is omitted.

Referring to FIGS. 8 and 9, a digital embroidery pattern of the digital garment according to the embodiment of the present invention is formed by interlocking a digital yarn as the upper thread 3210 and another digital yarn as the lower thread 3220.

The upper thread 3210 includes metal parts 3210*a* and a coating portion 3210*b* surrounding the metal parts 3210*a*. Voids 3210*c* as vacant spaces may be formed between the metal parts 3210*a* and the coating portion 3210*b*. The construction and functions of the upper thread 3210 are the same as those of the upper thread 1210 illustrated in FIGS. 2 and 3, and repeated explanation is omitted.

Like the lower thread 1220 illustrated in FIG. 2, the lower thread 3220 is interlocked with the upper thread 3210 while passing through hooks, which are formed by bending the upper thread 3210 on the second side 1100*b* of the garment 1100, and is disposed parallel to the second side 1100*b* of the garment 1100. Merely, the lower thread 3220 is a digital yarn, and specifically includes one or more metal parts 3220*a* positioned at the center of the cross section thereof and a coating portion 3220*b* surrounding the metal parts 3220*a*. Voids 3220*c* may be formed in vacant spaces between the metal parts 3220*a* and the coating portion 3220*b*.

As described above, digital yarns are used as the upper thread 3210 and the lower thread 3220 forming the digital embroidery pattern in the digital garment according to the embodiment of the present invention. Therefore, the number of the digital yarns serving as substantial communication paths in the garment 1100 in the digital garment according to the embodiment of the present invention is larger than that in the digital garment 1000 using a digital yarn as the upper threads 1210 and a sewing yarn as the lower thread 1220 forming the digital embroidery pattern 1200. The increased number of digital yarns in the digital garment according to the embodiment of the present invention enables large-capacity communications at high speed.

Hereinafter, a description will be given of the constitution of a digital garment (not shown) using embroidery technology according to another embodiment of the present invention.

Figure 10:
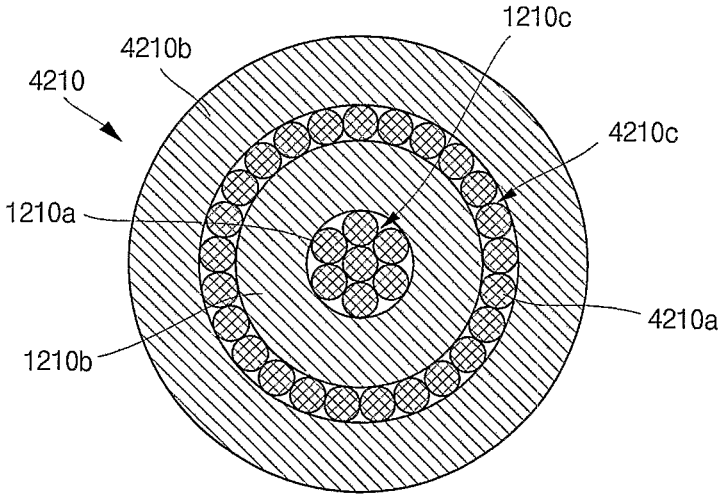
FIG. 10 is a cross-sectional view of a digital yarn as an upper thread of a digital garment using embroidery technology according to another embodiment of the present invention.

FIG. 10 is a cross-sectional view of a digital yarn as an upper thread of the digital garment.

The digital garment according to the embodiment of the present invention has the same elements and functions as the digital garment 1000 according to the previous embodiment of the present invention except for the constructions of the digital yarn using as the upper threads among the lower threads the upper threads which are forming a digital embroidery pattern, and thus the description of the same elements is omitted.

The digital embroidery pattern of the digital garment according to the embodiment of the present invention is formed by interlocking a digital yarn as the upper thread 4210 and the lower thread 1220.

Referring to FIG. 10, the upper thread 4210 may include metal parts 1210*a*, a coating portion 1210*b*, a plurality of outer metal parts 4210*a* arranged at the periphery of the coating portion 1210*b*, and an outer coating portion 4210*b* formed so as to surround the outer metal parts 4210*a*.

Voids 1210*c* may be formed between the metal parts 1210*a* and the coating portion 1210*b* during processing. Voids 4210*c* may be formed in regions defined by the coating portion 1210*b*, the outer metal parts 4210*a* and the outer coating portion 4210*b*.

The outer metal parts 4210*a* are arranged at regular intervals along the outer circumference of the coating portion 4210*b*. Alternatively, the outer metal parts 4210*a* may be compactly arranged so as to surround the periphery of the coating portion 1210*b*.

The outer metal parts 4210*a* shield electromagnetic waves generated when an electric current flows through the metal parts 1210*a* to prevent electromagnetic waves from reaching the wearer's body.

The outer metal parts 4210*a* are made of the same material as the metal parts 1210*a*. The outer metal parts 4210*a* formed outside the metal parts 1210*a* have a sectional area larger than that of the metal parts 1210*a*. This construction allows the outer metal parts 4210*a* to easily absorb electromagnetic waves generated from the metal parts 1210*a* and external electromagnetic noise. Therefore, the outer metal parts 4210*a* can further improve the ability of the coating portion 1210*b* to shield electromagnetic waves.

The outer coating portion 4210*b* is formed so as to surround the outer metal parts 4210*a*. The outer coating portion 4210*b* is made of the same material as the coating portion 1210*b* to shield electromagnetic waves generated from the metal parts 1210*a* and external electromagnetic noise.

As described above, a digital embroidery pattern of the digital garment according to the embodiment of the present invention is formed using the upper thread 4210, which includes the outer metal parts 2212*a* and the outer coating portion 2212*b* formed outside the metal parts 1212*a* and the coating portion 1212*b*. With this configuration, the digital garment according to the embodiment of the present invention shields electromagnetic waves generated when an electric current passes through the metal parts 1210*a* to prevent the electromagnetic waves from reaching the wearer's body and shields external electromagnetic noise to prevent the external electromagnetic noise from entering the metal parts 1210*a* in a more efficient manner.

The upper thread 4210 may further include a plurality of cover yarns (not shown) on the surface of the outer coating portion 4210*b*. The cover yarns further increases the strength of the upper thread 4210 to prevent the digital yarn from being snapped due to friction during embroidery or washing and to permit the performance of the upper thread 4210 as a communication line or an antenna to be maintained for a long period of time.

Hereinafter, a description will be given of a method for fabricating a digital garment using embroidery technology according to the present invention reference.

Figure 11:
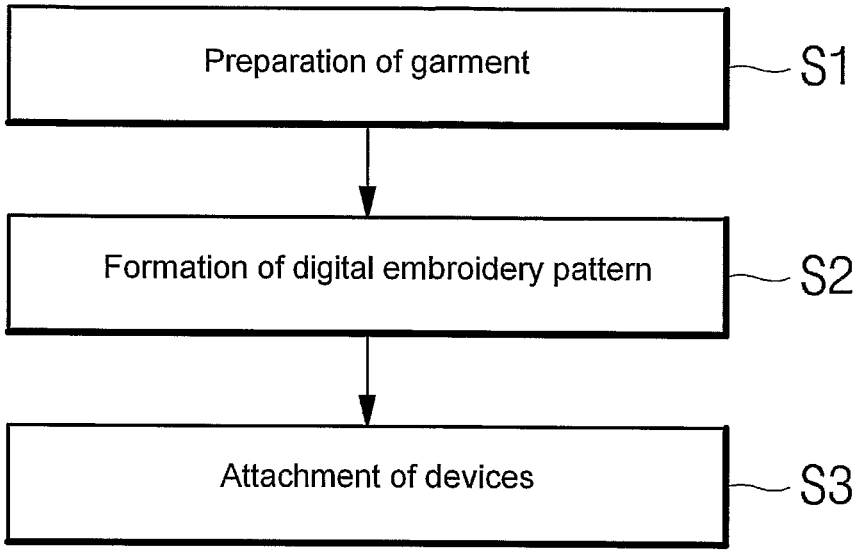
FIG. 11 is a flow chart illustrating a method for fabricating a digital garment using embroidery technology according to an embodiment of the present invention.

FIG. 11 is a flow chart illustrating a method for fabricating a digital garment 1000 using embroidery technology according to an embodiment of the present invention.

Referring to FIG. 11, the method may comprise the following steps: preparation of a garment (S1), formation of a digital embroidery pattern (S2) and attachment of devices (S3). The individual steps of FIG. 11 will be explained with reference to FIGS. 1 through 4.

In step S1, a garment 1100 as a basic element of the digital garment 1000 is prepared. The garment 1100 may be any suitable garment. It should be understood that although an upper garment is illustrated as the garment 1100 in FIG. 1, the garment 1100 may be any clothing product such as a lower garment or a one-piece garment. The garment 1100 may have a first side 1100*a* and a second side 1100*b* opposite to each other.

In step S2, a digital embroidery pattern 1200 is formed along the inner or outer surface of the garment 1100 to provide a communication path to the garment 1100. D The digital embroidery pattern 1200 is formed by interlocking an upper thread 1210 and a lower thread 1220 using an embroidery machine. Specifically, the digital embroidery pattern 1200 is formed using an embroidery machine by the following procedure. The upper thread 1210 sequentially penetrates the first and second sides 1100*a* and 1100*b* of the garment 1100 and is bent on the second side 1100*b* of the garment 1100 to form a hook 1212, and the lower thread 1220 is interlocked with the upper thread 1210 while passing through the hook 1212. And, the upper thread 1210 sequentially penetrates the second and first sides 1100*b* and 1100*a* of the garment 1100 to form a desired shape on the first side 1100*a* of the garment 1100.

In step S3, various devices 1300 through 1800 are attached to the garment 1100 and electrically connected to the digital embroidery pattern 1200.

Various methods may be used to attach the devices 1300 through 1800 to the garment 1100. For example, the devices 1300 through 1800 in the form of buttons or fabrics may be attached to the garment 1100. Alternatively, the devices 1300 through 1800 may be coupled to supports, which are previously attached to the garment 1100.

Alternatively, the devices 1300 through 1800 may be electrically connected to the digital embroidery pattern 1200 using connectors or by soldering. It should, of course, be noted that the connected portions between the digital embroidery pattern 1200 and the devices 1300 through 1800 are waterproofed to prevent water from entering the devices during washing.

The present invention has been described herein with reference to the foregoing embodiments. These embodiments do not serve to limit the invention, but are set forth for illustrative purposes. Accordingly, those skilled in the art will appreciate that various modifications and changes are possible, without departing from the spirit of the present invention as disclosed in the accompanying claims. It is to be understood that such modifications and changes are within the scope of the present invention.

This work was supported by the IT R&D program of MIC/IITA. [2006-S-029-02, Design and Development of Woven UFC (Ubiquitous Fashionable Computer) Technology]

The invention claimed is:

1. A digital garment using embroidery technology, comprising a garment made of a textile and having one side and the other side opposite to each other, a digital embroidery pattern formed along the inner or outer surface of the garment using embroidery technology to provide a communication path to the garment, a sensor attached to the garment and electrically connected to the digital embroidery pattern to convert physical signals to electrical signals, an arithmetic unit attached to the garment and electrically connected to the digital embroidery pattern to process the electrical signals inputted from the sensor, and a communication module attached to the garment and electrically connected to the digital embroidery pattern to perform wireless communication, wherein the digital embroidery pattern comprises upper threads that sequentially penetrate the one side and the other side of the garment to form hooks on the other side of the garment and sequentially penetrate the other side and the one side of the garment to form a desired shape on the one side of the garment, and lower threads interlocked with the upper threads while passing through the hooks on the other side of the garment, either the upper threads or the lower threads or both being digital yarns, wherein each of the digital yarns comprises a plurality of metal parts positioned at the center of the cross section thereof to provide a communication path, a coating portion surrounding the metal parts to shield electromagnetic waves, a plurality of outer metal parts arranged along the outer circumference of the coating portion, and an outer coating portion surrounding the outer metal parts.

2. The digital garment of claim 1, wherein the upper threads are digital yarns and the lower threads are sewing yarns.

3. The digital garment of claim 2, wherein the sewing yarns are composed of a material selected from cotton, silk, linen and synthetic fibers.

4. The digital garment of claim 1, wherein the upper threads are sewing yarns and the lower threads are digital yarns.

5. The digital garment of claim 1, wherein both the upper and lower threads are digital yarns.

6. The digital garment of claim 1, wherein the metal part is made of a material selected from the group consisting of copper, copper alloys, silver, silver alloys, gold, gold alloys, brass and combinations thereof.

7. The digital garment of claim 1, further comprising a display attached to the garment and electrically connected to the digital embroidery pattern to display processing results from the arithmetic unit as images.

8. The digital garment of claim 7, wherein the display is a liquid crystal display (LCD) or an organic light emitting display (OLED).

9. The digital garment of claim 1, further comprising an input pad attached to the garment and electrically connected to the digital embroidery pattern to apply electrical input signals to the arithmetic unit.

10. The digital garment of claim 1, further comprising an electric module attached to the garment so as to be electrically connected to the digital embroidery pattern.

11. The digital garment of claim 1, wherein a plurality of voids are formed in regions defined by the coating portion, the outer metal parts and the outer coating portion.

12. The digital garment of claim 1, wherein the outer metal parts have a sectional area larger than that of the metal parts.

13. A method for fabricating a digital garment using embroidery technology, the method comprising preparing a garment made of a textile and having one side and the other side opposite to each other, forming a digital embroidery pattern along the inner or outer surface of the garment using an embroidery machine to provide a communication path to the garment, and attaching devices to the garment and electrically connecting the devices to the digital embroidery pattern, wherein the digital embroidery pattern is formed using an embroidery machine by allowing upper threads to sequentially penetrate the one side and the other side of the garment to form hooks on the other side of the garment, allowing lower threads to pass through the hooks to interlock the lower threads with the upper threads on the other side of the garment, and allowing the upper threads to sequentially penetrate the other side and the one side of the garment to form a desired shape on the one side of the garment, either the upper threads or the lower threads or both being digital yarns, wherein each of the digital yarns comprises a plurality of metal parts positioned at the center of the cross section thereof to provide a communication path, a coating portion surrounding the metal parts to shield electromagnetic waves, a plurality of outer metal parts arranged along the outer circumference of the coating portion, and an outer coating portion surrounding the outer metal parts.

14. The method of claim 13, wherein the devices comprise a sensor, an arithmetic unit and a communication module.

15. The method of claim 13, further comprising at least one device selected from displays, input pads and electric modules that is attached to the garment and electrically connected to the digital embroidery pattern.

16. The method of claim 13, wherein a plurality of voids are formed in regions defined by the coating portion, the outer metal parts and the outer coating portion.

17. The method of claim 13, wherein the outer metal parts have a sectional area larger than that of the metal parts.

* * * * *